US007194858B2

(12) United States Patent
Ziph et al.

(10) Patent No.: US 7,194,858 B2
(45) Date of Patent: Mar. 27, 2007

(54) HYDROGEN EQUALIZATION SYSTEM FOR DOUBLE-ACTING STIRLING ENGINE

(75) Inventors: Benjamin Ziph, Ypsilanti, MI (US); Christopher Domanski, Ypsilanti, MI (US)

(73) Assignee: STM Power, Inc., Ann Arbor, MI (US)

( * ) Notice: Subject to any disclaimer, the term of this patent is extended or adjusted under 35 U.S.C. 154(b) by 27 days.

(21) Appl. No.: 11/216,503

(22) Filed: Aug. 31, 2005

(65) Prior Publication Data

US 2007/0044467 A1 Mar. 1, 2007

(51) Int. Cl.
*F01B 29/10* (2006.01)

(52) U.S. Cl. ..... 60/525; 60/517

(58) Field of Classification Search ..... 60/517, 60/520, 525

See application file for complete search history.

(56) References Cited

U.S. PATENT DOCUMENTS 3,865,015 A * 2/1975 Hakansson ..... 92/78
4,257,230 A * 3/1981 Lundholm ..... 60/517
4,481,771 A 11/1984 Meijer et al.
4,579,046 A 4/1986 Meijer et al.
4,601,171 A * 7/1986 Stotts ..... 60/521
4,615,261 A 10/1986 Meijer
4,669,736 A 6/1987 Meijer
4,836,094 A 6/1989 Meijer et al.
5,085,054 A * 2/1992 Katsuda et al. ..... 60/517
5,611,201 A 3/1997 Houtman
5,706,659 A 1/1998 Houtman et al.
5,722,239 A 3/1998 Houtman
5,865,091 A 2/1999 Domanski et al.
5,938,207 A 8/1999 Marchionna et al.
2005/0175468 A1 * 8/2005 Gurski et al. ..... 417/222.2

* cited by examiner

*Primary Examiner*—Hoang Nguyen
(74) *Attorney, Agent, or Firm*—Brinks Hofer Gilson & Lione

(57) ABSTRACT

A working gas pressure equalization system for a multiple-cylinder, double-acting hot gas engine such as a Stirling engine of the type having a plurality of pistons reciprocatable within the cylinders defining a plurality of generally isolated cycle volumes of a working gas separated by the pistons. The equalization system incorporates passages through the piston connecting rods which connect between a space between piston rings and an equalization volume defined between a pair of sliding rod seals. This volume is defined by portions from each of the cylinders and is connected with individual cycle volumes by a valve, such as a one-way check valve. When a pressure is experienced in one of the cycle volumes different from the minimum pressure maintained and the equalization volume, minute gas leakage across the piston rings enables pressure among the volumes to be equalized.

8 Claims, 2 Drawing Sheets

HYDROGEN EQUALIZATION SYSTEM FOR DOUBLE-ACTING STIRLING ENGINE

FIELD OF THE INVENTION

This invention is related to a heat engine and particularly to an improved Stirling cycle engine incorporating features to equalize pressure among separated volumes of working gas within the engine.

BACKGROUND OF THE INVENTION

The basic concept of the Stirling engine dates back to a patent registered by Robert Stirling in 1817. The engine operates by causing a working gas to shuttle between regions of temperature difference accompanied by volume and pressure variations. Stirling engines have a reversible thermodynamic cycle and therefore can be used as a means of delivering mechanical output power from a source of heat, or can act as a heat pump through the application of mechanical input energy. Using various heat sources such as combusted fossil fuels or concentrated solar energy, mechanical power can be delivered by the engine. This energy can be used to generate electricity or can be directly mechanically coupled to a load. Numerous potential applications for Stirling engines have been identified, for example including: as prime moves for motor vehicles, solar energy production, waste heat recovery, and remote location electricity generation.

The Assignee of the present application, STM Power, Inc. (previously named Stirling Thermal Motors, Inc.), has made significant advances in the technology of Stirling machines through a number of years. Examples of such innovations include development of a compact and efficient basic Stirling machine configuration employing a parallel cluster of double-acting cylinders which are coupled mechanically through a rotating swashplate. In many applications, a swashplate actuator is implemented to enable the swashplate angle and therefore the pistons' stroke and swept volume to be changed in accordance with engine operating requirements.

Although the Assignee has achieved significant advances in Stirling machine design, there is a constant need to provide further refinements. In a double-acting, multiple-cylinder Stirling engines, isolated volumes of the working fluid, typically helium or hydrogen gas, are shuttled through the engine. In accordance with the thermodynamic cycle of a Stirling engine, these isolate volumes are cyclically compressed and expanded and shuttled between spaces having temperature differences. Due to dynamic conditions during operation, leakage, and start-up conditions, changes in the mass of gas contained in each of the isolated cycle volumes occurs. These differences in "charge" mass or volume in the isolated cycle volumes lead to imbalances and roughness in operation of the machine. Moreover, such imbalances place undesired mechanical forces on the moving parts of the engine, increase noise and vibration of the engine during operation, negatively affects thermal efficiency, and increase starting torque.

Even with ideal sealing among the working parts of the Stirling engine and uniform charge volumes of the working gas during operation, once the engine is shut down, the cycle volumes will be stopped at various stages of compression. Inevitably, the working gas will leak from high pressure areas to low pressure areas over a period of time. This results in a difference in charge volume between cycles since each defines a separated volume. Thus, upon starting the engine, a significant difference in charge volume exists between working gas cycles. This invention provides a system for equalizing working gas charge volumes between the isolated cycle volumes.

One approach toward providing pressure balancing between isolated cycle volumes in a multiple-cylinder Stirling engine is described in Assignee's U.S. Pat. No. 5,813,229. That patent describes allowing each of the cycle volumes to communicate via a small diameter capillary tube. Although this system will result in pressure balancing over time, it has the disadvantage of creating a constant loss in efficiency due to an exchange of gas between cycles, even where pressure balance conditions do not exist. This occurs since the capillary tube is exposed to out-of-phase pressure variations and consequently there is a constant shuttling flow of gases through the capillary tubes.

SUMMARY OF THE INVENTION

In accordance with this invention, a system is provided for allowing minute transfers of working gas between cycle volumes to occur in a manner which enables their minimum pressures and consequently their total charge volumes to be equalized. This has the affect of producing a smoother running engine and addresses the previously mentioned shortcomings of Stirling engines in accordance with the prior art technology.

The Stirling engine innovations of the present invention may be implemented in numerous engine configurations, including the types previously developed by the Assignee, including those described in U.S. Pat. Nos. 4,481,771; 4,579,046; 4,615,261; 4,669,736; 4,836,094; 5,611,201; 5,706,659; 5,722,239; 5,865,091; and 5,938,207, which are hereby incorporated by reference. Basic features of many of the Stirling machines described in the above-referenced patents are also implemented in connection with the present invention.

The system of the present invention utilizes a piston having a hollow connecting rod which passes through a pair of separated rod seals. The interior passage of the connecting rod communicates with an annular piston seal volume between a pair of axially separated piston sealing rings. The connecting rod hollow passage communicates with volumes for each cylinder which are all connected together via passageways to form an equalization volume or plenum. This plenum is maintained at a minimum cycle pressure level through the use of a valves such as one-way check valves which communicate with the individual cycle volumes. In operation, the equalization volume is maintained at the lowest minimum cycle pressure in the system. Working gas is able to move into any cycle volumes which exhibit a minimum pressure which differs from the plenum pressure by leakage of working gas past the piston rings.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
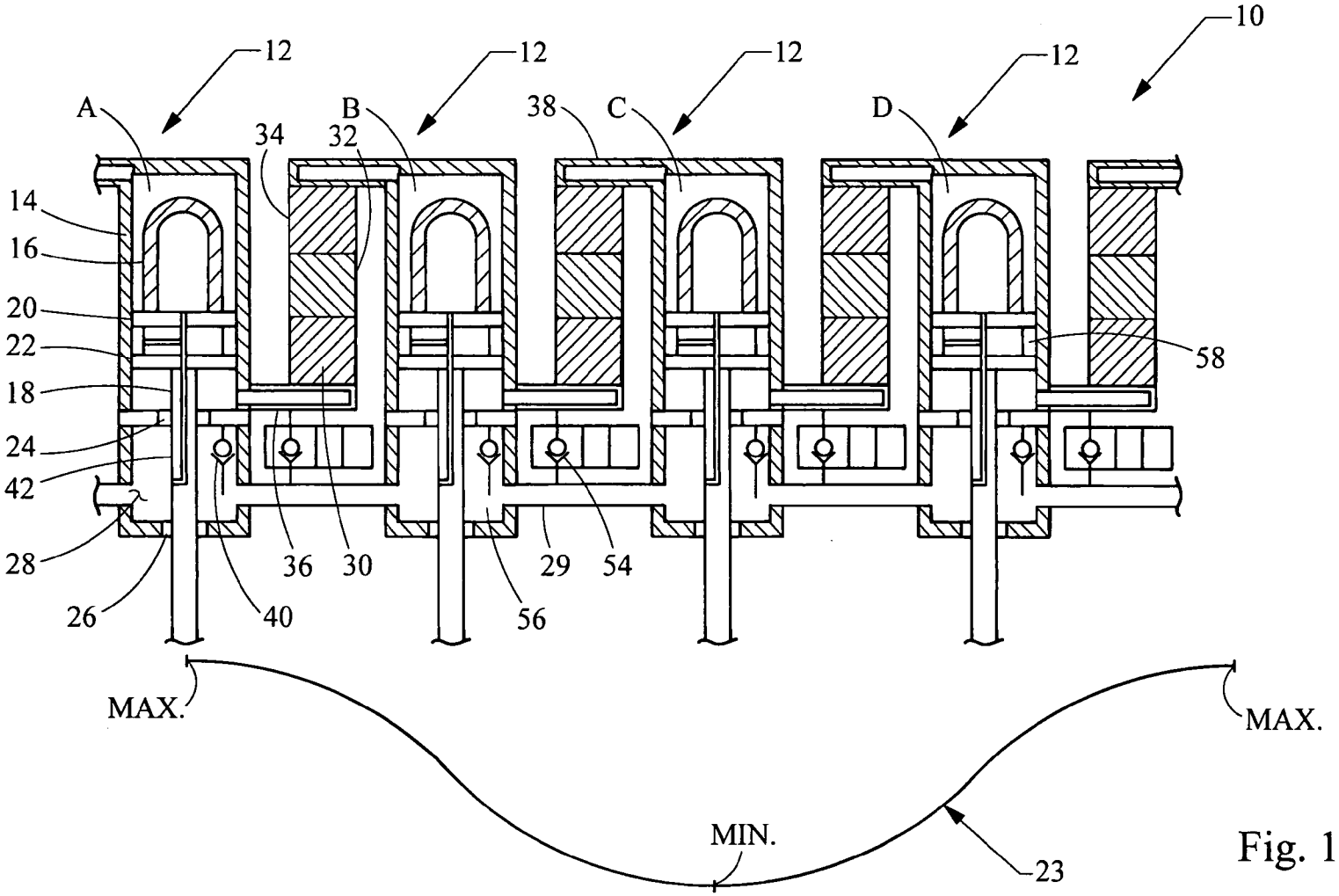
FIG. 1 is a schematic illustration of a four-cylinder, double-acting Stirling engine incorporating the features of the present invention.

With reference to FIG. 1, a multiple-cylinder double-acting Stirling engine is shown in schematic manner and is generally designated by reference number 10. Stirling engine 10 consists of four generally identical cylinder assemblies 12, each including cylinder bore 14 with a piston 16 reciprocatable within the cylinder bore. A connecting rod 18 is coupled to each of the pistons 16 and is connected with a drive system, such as a kinematic swashplate-type drive system of the type as described in Applicant's previously mentioned U.S. patents incorporated herein by reference. Other drives known include magnetically coupled systems and so-called "free piston" designs which operate in a resonance condition. The drive system 23 is shown diagrammatically to provide a generally sinusoidal motion of the pistons 16. The cylinder assemblies 12 of Stirling engine 10 are preferably arranged in a square cluster but are shown side-by-side in FIG. 1 for purposes of illustration. Accordingly, the cylinder assembly 12 shown at the left-hand side of FIG. 1 is, in practice, positioned adjacent to the cylinder assembly 12 shown on the right-hand side of that figure.

A pair of piston rings 20 and 22 provide sealing in the radial space between piston 16 and the inside diameter of cylinder bore 14, and these components defined an annular piston seal volume 58. Sliding rod seal 24 allows reciprocation of connecting rod 18 while providing a fluid seal. Similarly, rod seal 26 also provides a fluid seal for connecting rod 18. Rod seals 24 and 26 are separated to define partial equalization volume 28 for each of the cylinder assemblies 12. Each of pistons 16 act as moving boundaries of pairs of separated working gases cycle volumes, designated as cycle volumes "A", "B", "C" and "D" in FIG. 1. As mentioned previously, typically used working gases for Stirling engines include helium and hydrogen (and in some cases, air). Each of the cycle volumes A, B, C, and D is bound by the lower surface of one of pistons 16 and rings 22 at one boundary, and the upper surface and upper piston ring 20 of an adjacent piston 16 of a connected cylinder assembly 12. The lower portion of each cylinder assembly 12 connects via a duct 36 through a heat exchanger stack which includes cooler 30, regenerator 32, and heater 34. Gas flowing in the region of cooler 30 has heat removed, whereas heat is transferred to the working gas when it resides in heater 34. Regenerator 32 acts to provide heat energy storage which is heated when hot gasses flow through it and gives up heat when relatively cooler gasses are moved through it. Cooler 30, regenerator 32, and heater 34 are well-known basic components of Stirling engines. Ducts 36 and 38 communicate the cycle volumes A, B, C and D between the adjacent cylinder assemblies 12 and the heat exchanger stacks mentioned previously. In operation, through coordinated out-of-phase reciprocating motion of each of connecting rods 18 provided by drive system 23, cyclical variations in the pressure of each of the cycle volumes bound by the movable boundaries occurs as described previously.

One-way check valves 40 are provided which communicates the cycle volumes A, B, C, and D to equalization volume 28. Check valves 40 are oriented such that gas flow only occurs from the equalization volume 28 to the connected cycle volume when a pressure difference occurs between them in the direction designated in FIG. 1; namely, when the lower pressure exists in the cycle volume. Equalization volumes 28 for each cylinder assembly communicate via ducts 29 to define a collective equalization volume or plenum (also designated by reference number 28).

Figure 2:
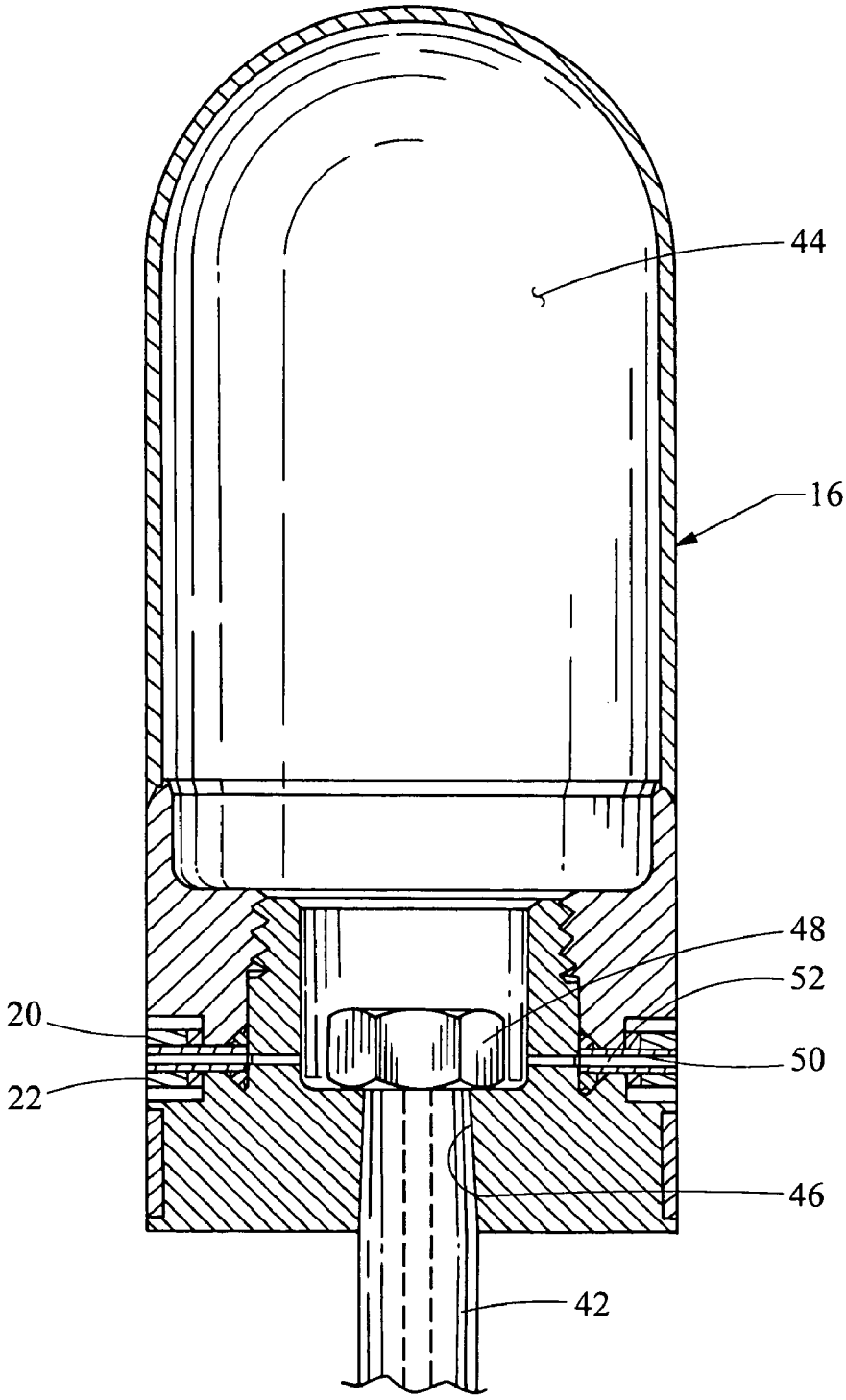
FIG. 2 is a cross-sectional view through a piston for use in connection with the engine shown in FIG. 1.

Connecting rod 18 incorporates a central passageway 42 which communicates with the annular piston seal volume 58 between piston rings 22 and 24. A more detailed illustration of this configuration is provided with reference to FIG. 2. FIG. 2 illustrates piston 16 having a hollow dome interior 44. Piston 16 is constructed as described by U.S. Pat. No. 5,865,091 which is incorporated herein by reference. Connecting rod 18 is mounted to piston 16 through a friction-fit tapered bore 46 and is retained in position by retainer nut 48. Piston rings 22 and 24 are axially separated by spacer ring 50. Spacer ring 50 features an internal passageway 52 which communicates to the hollow dome interior 44. Similarly, connecting rod passageway 42 also communicates with the hollow dome interior volume 44. Hollow dome interior 44 increases the combined volume of the equalization plenum and further reduces gas pressure in piston 16 which additionally reduces convective heat transfer across the piston.

For unloading Stirling engine 10, a series of valves 54 are employed which open ducts 36 with the equalization volume 28 and can be opened and closed by remote electrical controls. When valves 54 are opened, for example through energizing a solenoid, the Stirling engine 10 does not operate through a closed thermodynamic cycle. Valves 54 are provided for unloading engine 10 for use in start-up conditions or when complete unloading of the engine is desired during operation. It is noted that valves 54 communicate between the same spaces as one-way check valves 40 (which are pressure actuated). The difference between the valves is a greater flow capacity of valves 54 and their external actuation, as compared with the one-way check valves 40. Two separate sets of valves 40 and 54 are not essential to realize the benefits of the present invention. In another implementation of the invention, valves 40 can be eliminated, with valves 54 functioning for opening during start-up conditions through a remote control signal, and when closed, acting as a one-way pressure actuated valve, thus acting as check valve 40.

Equalization volumes 28 each define in their aggregate, a plenum which is maintained at the minimum cycle pressure experienced by the cycle volumes by means of operation of check valves 40 (or as mentioned above, valve 54). Working gas cannot transfer from one cycle volume to another without going through common plenum 56. In this manner, the gas pressure within plenum 56 is held a minimum cycle pressure in each cycle through the operation of check valves 40. As mentioned previously, when Stirling engine stops, the pistons 16 of each cylinder assembly 12 stop at a different position and each of the isolated cycle volumes A, B, C and D will have a different volume and pressure. After the Stirling engine 10 remains stationary for a period of time, the pressure of these isolated cycle volumes A, B, C, and D will tend to equalize due to leakage, for example across piston rings 20 and 22. This inequality in the charge volume among the cycle volumes for a stationary engine with give rise to high torque required to start the engine and imbalances during operation. To reduce the starting torque, the valves 54 are activated to open which communicates each of the cycle volumes to the common plenum 56. This condition unloads the engine and allows the charges to equalize among the cycle volumes for the first few revolutions of the engine. After a short time after start-up, valves 54 are deactivated and the system reaches steady-state operation.

The connection of the space between piston rings 22 and 24 to the plenum 56 held at a minimum pressure, provides the equalization function for the system of this invention. This connection prevents a net transfer of gas charge between adjacent cycles without involving the plenum 56. In operation, plenum 56 is held at an "average" minimum pressure for each of the cycle volumes A, B, C and D. When variations in the minimum pressure for an individual cycle volume occurs during its cyclical variation in pressure, leakage of working gas to or from that volume occurs past rings 20 and/or 22.

Numerous varieties may be provided within the scope of this invention. For example, in a physical implementation of this invention, the various ducts 29, 36, and 38 may be passageways or communication paths without requiring a separate pipe or coupling.

While the above description constitutes the preferred embodiment of the present invention, it will be appreciated that the invention is susceptible to modification, variation and change without departing from the proper scope and fair meaning of the accompanying claims.

The invention claimed is:

1. A working gas pressure equalization system for a multiple-cylinder, double-acting hot gas engine including a Stirling engine of the type having a plurality of pistons reciprocatable within cylinder bores defining a plurality of generally isolated cycle volumes of a working gas separated by the pistons, the motion of the pistons controlled by a drive to cause variations in pressure of the cycle volumes, the equalization system comprising:

a connecting rod affixed to each of the pistons and coupled with the drive, a first rod seal and a second rod seal acting on each of the connecting rods defining therebetween an equalization volume of the working gas, pair of piston rings for each of the pistons for sealing the pistons within the cylinder bores, the piston rings being axially separated to form an annular piston seal volume bounded by the pair of rings, the pistons and the cylinder bores, a passageway formed by each of the connecting rods communicating the annular piston seal volumes with the equalization volume, and a valve communicating the cycle volumes with the equalization volume allowing the flow of the working gas from the equalization volume to the cycle volumes.

2. A working gas pressure equalization system in accordance with claim 1 wherein the equalization volume is comprised of discrete partial equalization volumes for each of the cylinders which are connected together via a duct to form the equalization volume.

3. A working gas pressure equalization system in accordance with claim 1 further comprising one or more unloader valves communicating between the cycle volumes and the equalization volume and operable through a control signal to provide fluid communication between the cycle volumes and the equalization volume to thereby unload the engine and which further can be closed to allow normal operation of the engine.

4. A working gas pressure equalization system in accordance with claim 1 wherein the valve is a one-way check valve allowing flow of the working gas only in the direction from the equalization volume to the cycle volume.

5. A working gas pressure equalization system in accordance with claim 1 wherein the piston rings are axially separated by a spacer ring.

6. A working gas pressure equalization system in accordance with claim 5 wherein the spacer ring forms a portion of the passageway.

7. A working gas pressure equalization system in accordance with claim 1 wherein the pistons are hollow with an interior and the interior comprising a portion of the equalization volume.

8. A working gas pressure equalization system in accordance with claim 1 wherein the valve functions as an unloader valve which can be opened by a control signal to provide fluid communication between the cycle volumes and the equalization volume to thereby unload the engine and which further can be closed, and wherein, when the unloader valve is closed, it operates as a one-way check valve allowing flow of the working gas only in the direction from the equalization volume to the cycle volume.

* * * * *